US007050732B2

(12) United States Patent
Bae et al.

(10) Patent No.: US 7,050,732 B2
(45) Date of Patent: May 23, 2006

(54) ELECTROPHOTOGRAPHIC IMAGE-FORMING APPARATUS AND CHARGING VOLTAGE CONTROL METHOD THEREOF

(75) Inventors: Dyoung-chul Bae, Suwon (KR); Ui-Choon Lee, Suwon (KR); Su-jong Jeong, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 70 days.

(21) Appl. No.: 10/750,840

(22) Filed: Jan. 5, 2004

(65) Prior Publication Data

US 2004/0190921 A1 Sep. 30, 2004

(30) Foreign Application Priority Data

Mar. 26, 2003 (KR) ..... 10-2003-0018819

(51) Int. Cl.
*G03G 15/02* (2006.01)

(52) U.S. Cl. ..... 399/50; 399/66; 399/88; 399/89

(58) Field of Classification Search ..... 399/46, 399/48, 50, 66, 168, 174, 176, 297, 310, 399/313, 307, 88, 89
See application file for complete search history.

(56) References Cited

U.S. PATENT DOCUMENTS 6,782,215 B1 * 8/2004 Komori ..... 399/50

* cited by examiner

*Primary Examiner*—Hoang Ngo
(74) *Attorney, Agent, or Firm*—Staas & Halsey LLP

(57) ABSTRACT

An electrophotographic image-forming apparatus and a charging voltage control method therefor. The electrophotographic image-forming apparatus has a charging roller applying a predetermined voltage to a photosensitive medium, a developing roller for developing with a developing agent an electrostatic latent image formed on the photosensitive medium by a laser scanning unit, a transfer roller transferring onto a sheet of recording paper the image developed by the developing agent, and a high voltage power supply (HVPS) applying predefined voltages to the respective rollers. The apparatus also includes a charging roller resistance detection unit detecting a resistance value of the charging roller, a transfer roller resistance detection unit detecting a resistance value of the transfer roller, and a control unit determining the charging voltage to be applied to the charging roller based on the charging roller resistance value detected by the charging roller resistance detection unit and the transfer roller resistance value detected by the transfer roller resistance detection unit. Accordingly, the present invention can adaptively select a charging voltage to be applied to the charging roller depending upon the changes of the transfer roller resistance value and the charging roller resistance value.

16 Claims, 4 Drawing Sheets

ELECTROPHOTOGRAPHIC IMAGE-FORMING APPARATUS AND CHARGING VOLTAGE CONTROL METHOD THEREOF

CROSS-REFERENCE TO RELATED APPLICATIONS

This application claims the benefit of Korean Application No. 2003-18819, filed Mar. 26, 2003, in the Korean Intellectual Property Office, the disclosure of which is incorporated herein by reference.

BACKGROUND OF THE INVENTION

1. Field of the Invention

The present invention relates to an electrophotographic image-forming apparatus and a charging voltage control method. More particularly, the present invention relates to an electrophotographic image-forming apparatus and a charging voltage control method capable of preventing print quality deterioration due to uneven surface potentials of a photosensitive medium caused by resistance value changes resulting from aging or poor contacts of a charging roller or a transfer roller.

2. Description of the Related Art

In general, the electrophotographic image-forming apparatus is employed in image-forming devices such as laser beam printers, LED print head (LPH) printers, copiers and facsimile machines. Such an electrophotographic image forming apparatus performs printing jobs through the process of charging, exposing, developing, transferring and fusing.

FIG. 1 is a cross-section view schematically showing a conventional electrophotographic image-forming apparatus. Referring to FIG. 1, an electrophotographic image-forming apparatus has a photosensitive drum 10, a charging roller 20, a laser scanning unit (LSU) 30, a developing roller 40, a transfer roller 50, a high voltage power supply (HVPS) 60, and a control unit 70.

During printing operations the HVPS 60 applies predetermined voltages to the charging roller 20, developing roller 40, and transfer roller 50 according to the controls of the control unit 70. The charging roller 20 uniformly charges the surface of the photosensitive drum 10 with the charging voltage applied from the HVPS 60. The LSU 30 scans light on the photosensitive drum 10 corresponding to image data input from the control unit 70. Accordingly, an electrostatic latent image is formed on the surface of the photosensitive drum 10.

Thereafter, the electrostatic latent image formed on the surface of the photosensitive drum 10 turns into a toner image with toner supplied by the developing roller 40. The transfer roller 50 driven by the transfer voltage applied from the HVPS 60 transfers onto a sheet of recording paper the toner image formed on the photosensitive drum 10. The toner image transferred onto the sheet is fixed on the sheet of printing paper by applying high heat and pressure with a fusing device (not shown), and the sheet is discharged to the outside along the discharging direction and printing is completed.

The conventional electrophotographic image-forming apparatus brings concentration deviation out on the image recorded on the recording paper, which results in a poor print image when the surface potential formed on the photosensitive drum 10 becomes uneven while the print job is performed. Accordingly, it is beneficial to apply a constant charging voltage in order to maintain a uniform surface potential of the photosensitive drum 10. However, even though the constant charging voltage is applied to the charging roller 20, the charging potential of the photosensitive drum 10 may vary since resistance values of the respective rollers are changed due to ambient environment changes, for example, temperature and humidity changes. Therefore, the conventional electrophotographic image-forming apparatus determines the charging voltage to be applied to the charging roller 20 in consideration of such resistance value changes due to the environment changes.

For example, the conventional electrophotographic image-forming apparatus determines the charging voltage to be applied to the charging roller 20 based on the resistance value of the transfer roller 50. That is, the conventional electrophotographic image-forming apparatus detects the resistance values of the transfer roller 50 according to the ambient temperature and humidity changes, and varies the charging voltage to be applied to the charging roller 20 based on the detected resistance value, to compensate for print quality.

However, the resistance value of the transfer roller 50 may also vary due to mechanical defects such as aging or poor contacts of the transfer roller 50, in addition to the ambient environment changes. FIG. 2 shows the relationship between the aging and resistance values of the transfer roller 50 where the resistance value of the transfer roller 50 increases as the transfer roller 50 is getting older. As the transfer roller is used, the resistance value of the transfer roller 50 increases and overvoltage is applied to the charging roller 20, causing printed images that are blurred or image quality deterioration by the occurrence of a pinhole.

For another example, the electrophotographic image-forming apparatus determines a charging voltage to be applied to the charging roller 20 based on the resistance value of the charging roller 20. That is, the electrophotographic image-forming apparatus detects a resistance value of the charging roller 20, varies the charging voltage to be applied to the charging roller 20 based on the detected resistance value, and compensates for the variation of the surface potential of the photosensitive drum 10 according to printing environments. Even in this case, the measured resistance value of the charging roller 20 can be higher than the resistance value in actual environments due to mechanical defects such as poor contacts of the charging roller 20. If the resistance value of the charging roller 20 increases, the amount of toner applied on an electrostatic latent image is reduced, causing printed image deterioration.

As above, where a charging voltage to be applied to the charging roller 20 is determined by considering only one of the resistance values of the transfer roller 50 and the resistance value of the charging roller 20, an overvoltage is applied to the charging roller 20 because the resistance value of the transfer roller 50 or the charging roller 20 increases due to its mechanical defects such as aging or poor contacts. When an overvoltage is applied to the charging roller 20, a problem occurs as print images become blurred with lower image concentration.

SUMMARY OF THE INVENTION

The present invention has been devised to solve the above and/or other problems, so it is an aspect of the present invention to provide an electrophotographic image-forming apparatus and a charging voltage control method capable of preventing print quality deterioration due to aging or poor contacts of a charging roller or a transfer roller by determining a charging voltage to be applied to the charging roller based on both a resistance value of the transfer roller and a resistance value of the charging roller.

In order to achieve the above and/or other aspects, an electrophotographic image-forming apparatus according to the present invention comprises a charging roller for applying a predetermined voltage to a photosensitive medium, a developing roller developing with a developing agent an electrostatic latent image formed on the photosensitive medium by a laser scanning unit, a transfer roller transferring onto a sheet of recording paper the image developed by the developing agent, a high voltage power supply applying predefined voltages to the respective rollers, a charging roller resistance detection unit detecting a resistance value of the charging roller, a transfer roller resistance detection unit detecting a resistance value of the transfer roller, and a control unit determining a charging voltage to be applied to the charging roller based on the charging roller resistance value detected by the charging roller resistance detection unit and the transfer roller resistance value detected by the transfer roller resistance detection unit.

Additional aspects and/or advantages of the invention will be set forth in part in the description which follows and, in part, will be obvious from the description, or may be learned by practice of the invention.

In an aspect of the present invention, the electrophotographic image-forming apparatus further comprises a storage unit storing predetermined charging voltage values in correspondence to the transfer roller resistance value and the charging roller resistance value, wherein the control unit selects a charging voltage value stored in the storage unit based on the transfer roller resistance value and the charging roller resistance value, and controls the high voltage power supply to apply the selected charging voltage value to the charging roller.

In another aspect of the present invention, the charging roller resistance detection unit includes a charging roller resistance detector detecting currents flowing between the charging roller and the photosensitive medium and calculating the charging roller resistance value based on a value of detected currents, and an analog-to-digital (A/D) converter converting into a digital signal a signal corresponding to the charging roller resistance value outputted from the charging roller resistance detection unit and outputting the digital signal to the control unit.

In another aspect, the transfer roller resistance detection unit includes a transfer roller resistance detector detecting currents flowing between the transfer roller and the photosensitive medium and calculating the transfer roller resistance value based on a value of the detected currents, and an A/D converter converting into a digital signal a signal corresponding to the transfer roller resistance value outputted from the transfer roller resistance detector and outputting the digital signal to the control unit.

In another aspect, in order to achieve the above and/or other objects, a charging voltage control method for an electrophotographic image-forming apparatus having a charging roller applying a predetermined voltage to a photosensitive medium, a developing roller developing with a developing agent an electrostatic latent image formed on the photosensitive medium by an exposure unit, a transfer roller transferring onto a sheet of recording paper the image developed by the developing agent, a charging roller resistance detection unit detecting a resistance value of the charging roller, and a transfer roller resistance detection unit detecting a resistance value of the transfer roller, comprises steps of calculating the charging roller resistance value between the charging roller and the photosensitive medium, calculating the transfer roller resistance value between the transfer roller and the photosensitive medium, and determining a charging voltage to be applied to the charging roller based on the calculated transfer roller resistance value and charging roller resistance value.

In one aspect of the invention, the charging of the voltage determination operation determines a predefined charging voltage values as the charging voltage to be applied to the charging roller in correspondence.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
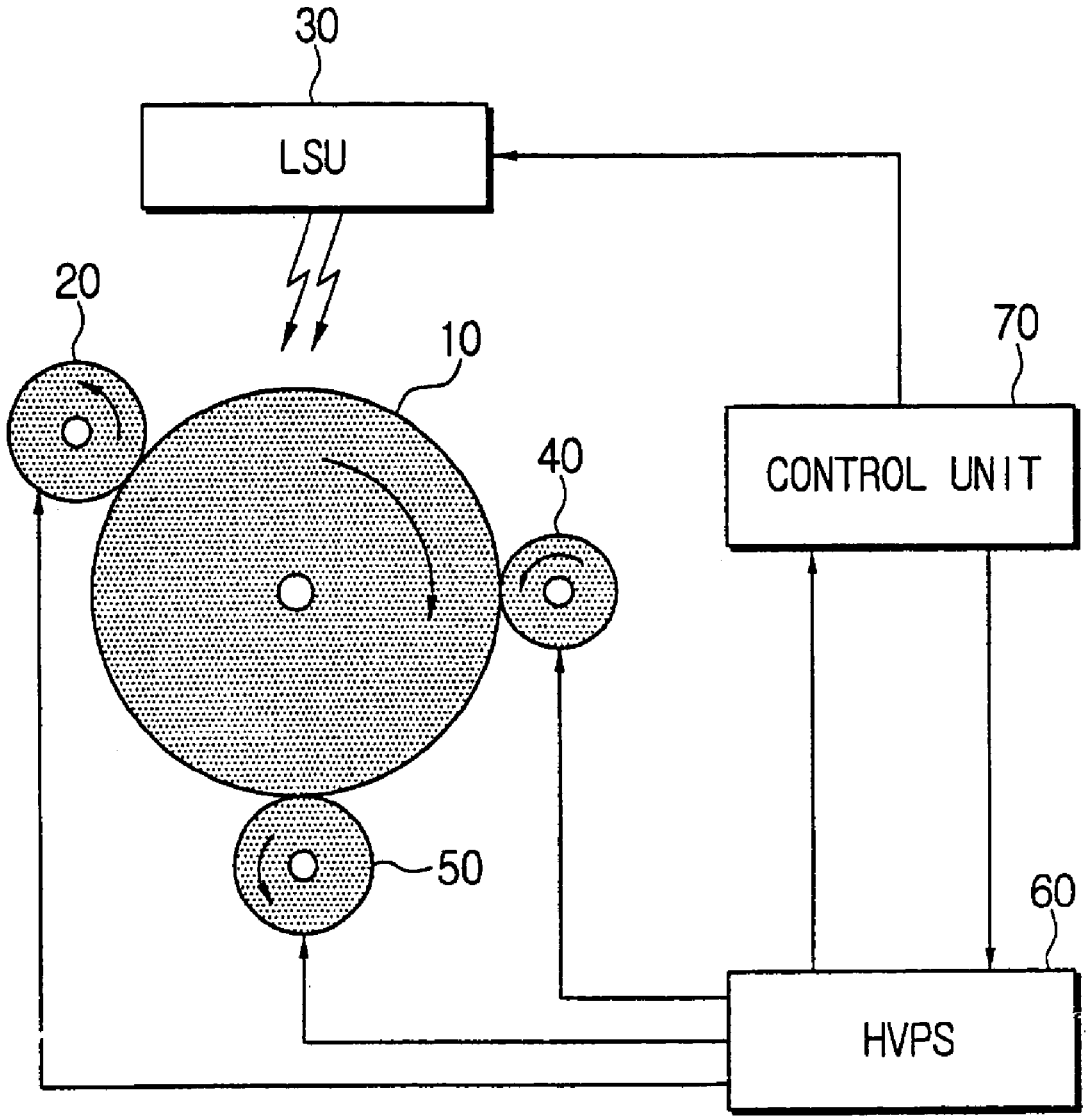
FIG. 1 (PRIOR ART)
FIG. 1 is a cross-section view schematically showing a conventional electrophotographic image-forming apparatus.
Figure 2:
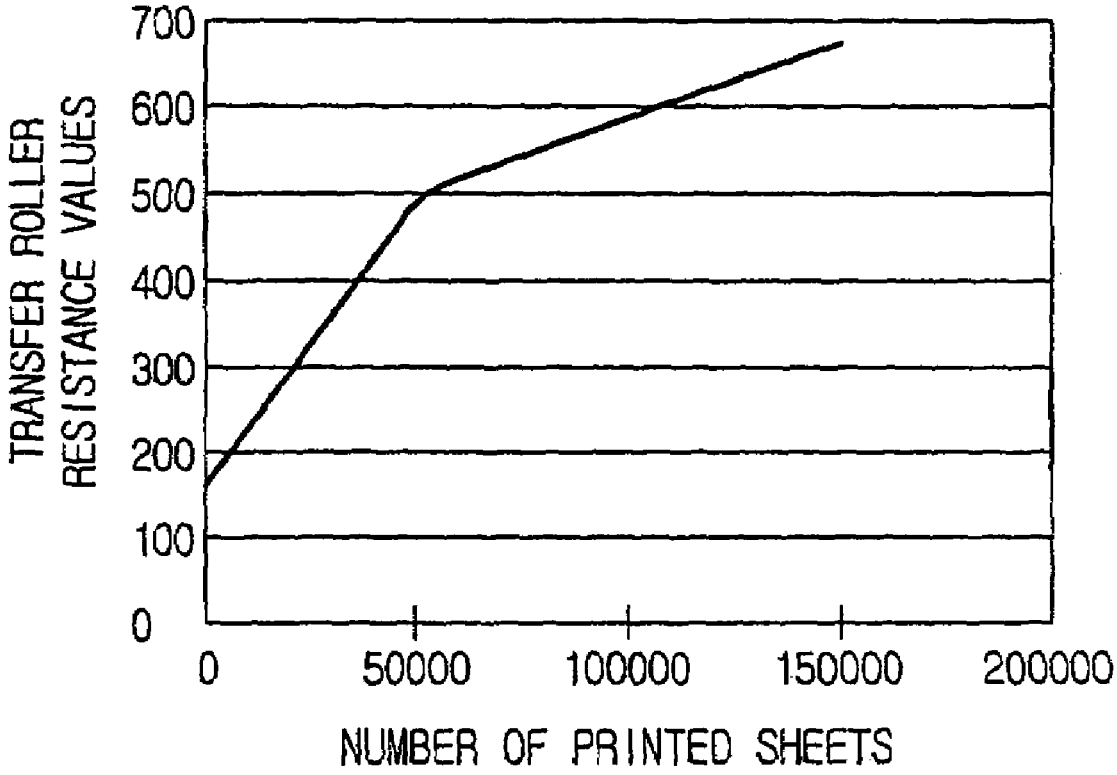
FIG. 2 (PRIOR ART)
FIG. 2 is a graph showing resistance value variations of a transfer roller according to the number of printed sheets of paper.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
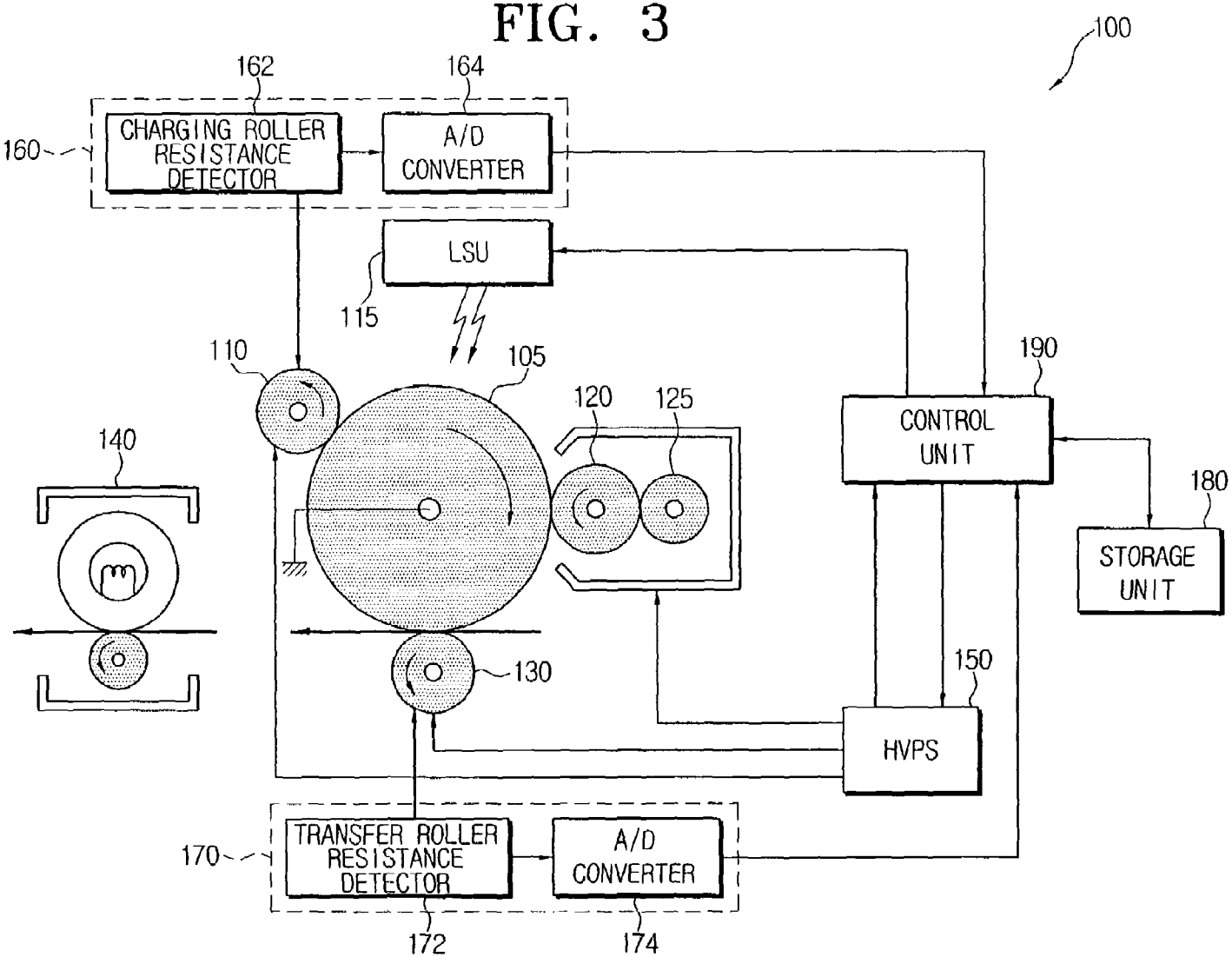
FIG. 3 is a cross-section view schematically showing an electrophotographic image-forming apparatus according to an embodiment of the present invention.

FIG. 3 is a block diagram showing an electrophotographic image-forming apparatus according to an embodiment of the present invention. Referring to FIG. 3, an electrophotographic image-forming apparatus 100 has a photosensitive drum 105, a charging roller 110, a laser scanning unit (LSU) 115, a developing roller 120, a transfer roller 130, a fusing unit 140, a high voltage power supply (HVPS) 150, a charging roller resistance detection unit 160, a transfer roller resistance detection unit 170, a storage unit 180, and a control unit 190.

The charging roller 110 charges the photosensitive drum 105 with a predetermined charging voltage applied from the HVPS 150.

The LSU 115 scans light corresponding to print data onto the photosensitive drum 105 according to the controls of the control unit 190. Accordingly, an electrostatic latent image is formed on the surface of the photosensitive drum 105. It is understood that LED strips may be used in place of the laser beam scanning unit 115.

The developing roller 120 develops the electrostatic latent image formed on the photosensitive drum 105 by the LSU 115 with a developing agent such as toner. Toner is transferred from a toner supply roller 125 to the developing roller 120 by a potential difference occurring between the toner supply roller 125 charged with a predetermined supply voltage, for example, −500V, and the developing roller 120 charged with a developing voltage, for example, −300V.

Accordingly, a toner image is formed on the electrostatic latent image portion of the photosensitive drum 105 by this developing unit.

In mutual contact with the photosensitive drum 105 with a transfer voltage supplied from the HVPS 150, the transfer roller 130 transfers the image development-processed on the photosensitive drum 105 onto an incoming sheet of recording paper.

The fusing unit 140 fixes the toner image transferred on the recording medium, for example, paper or transparency sheets, onto the recording medium by applying high heat and pressure. The fusing-completed recording medium is discharged outside along its discharging direction, and the print process is completed.

The HVPS 150 applies predetermined voltages to the respective rollers 110, 120, 125, and 130 of the electrophotographic image-forming apparatus 100 according to the controls of the control unit 190. For example, the HVPS 150 applies a predetermined charging voltage of −1.4 KV, a developing voltage of −300V, a supply voltage of −500V, and a transfer voltage of +2.0 KV to the charging roller 110, developing roller 120, supply roller 125, and transfer roller 130, respectively.

The charging roller resistance detection unit 160 has a charging roller resistance detector 162 and an A/D converter 164. The charging roller resistance detector 162 detects current flowing between the charging roller 110 and the photosensitive drum 105, and calculates the charging roller resistance value based on the charging voltage applied to the charging roller 110 and the detected current value. The calculated charging roller resistance value is output to the A/D converter 164.

The A/D converter 164 converts into a digital signal the charging roller resistance value output from the charging roller resistance detector 162, and outputs the digital signal to the control unit 190.

The transfer roller resistance detection unit 170 has a transfer roller resistance detector 172 and an AID converter 174. The transfer roller resistance detector 172 detects current flowing between the transfer roller 130 and the photosensitive drum 105, and calculates the transfer roller resistance value based on the detected current and the transfer voltage applied to the transfer roller 130. Further, the calculated transfer roller resistance value is output to the A/D converter 174.

The A/D converter 174 converts into a digital signal the transfer roller resistance value output from the transfer roller resistance detector 172, and outputs the digital signal to the control unit 190. It is understood that the transfer roller resistance detection unit 170 and the charging roller resistance detection unit 160 could be combined into one resistance detection unit that would determine resistances for both rollers.

The storage unit 180 stores various control programs necessary to implement functions of the image-forming device 100 and data occurring as the control programs are launched. Further, as shown in Table 1 below, the storage unit 180 stores pre-set charging voltage values in the form of a look-up table that corresponds to the transfer roller resistance values and the charging roller resistance values. The rows of Table 1 denote charging roller resistance values, and the columns of Table 1 denote transfer roller resistance values.

TABLE 1

| | 30 MΩ | 31 MΩ~50 MΩ | 51 MΩ~70 MΩ | 71 MΩ~100 MΩ | Over 100 MΩ |
|---|---|---|---|---|---|
| Below 40 MΩ | −1.35 KV | −1.37 KV | −1.37 KV | −1.37 KV | −1.37 KV |
| 41 MΩ~60 MΩ | −1.35 KV | −1.37 KV | −1.37 KV | −1.37 KV | −1.37 KV |
| 61 MΩ~80 MΩ | −1.35 KV | −1.37 KV | −1.40 KV | −1.40 KV | −1.40 KV |
| 81 MΩ~120 MΩ | −1.37 KV | −1.40 KV | −1.40 KV | −1.40 KV | −1.40 KV |
| 121 MΩ~160 MΩ | −1.37 KV | −1.40 KV | −1.40 KV | −1.42 KV | −1.42 KV |
| 161 MΩ~250 MΩ | −1.37 KV | −1.40 KV | −1.42 KV | −1.42 KV | −1.42 KV |
| 251 MΩ~500 MΩ | −1.42 KV | −1.42 KV | −1.42 KV | −1.42 KV | −1.45 KV |
| Over 500 MΩ | −1.42 KV | −1.42 KV | −1.45 KV | −1.45 KV | −1.45 KV |

The control unit 190 controls overall operations of the image-forming device 100 according to the control programs stored in the storage unit 180. In the present invention, the control unit 190 determines a charging voltage to be applied to the charging roller 110 based on a charging roller resistance value and a transfer roller resistance value output from the charging roller resistance detection unit 160 and the transfer roller resistance detection unit 170 respectively.

That is, the control unit 190, if a charging roller resistance value and a transfer roller resistance value are input from the charging roller resistance detection unit 160 and the transfer roller resistance detection unit 170, reads a predetermined charging voltage value from the storage unit 180 that corresponds to the input charging roller resistance value and transfer roller resistance value.

A description of an example process for selecting a charging voltage with reference to Table 1 is as follows. That is, when the charging roller resistance value is 130 MΩ and the transfer roller resistance value is 200 MΩ, the control unit 190 determines a charging voltage value of −1.42 KV as a charging voltage to be applied to the charging roller 110 since the value of —1.42 KV exists where the row of the charging roller resistance value of 130 MΩ meets with the column of the transfer roller resistance value of 200 MΩ.

That is, the control unit 190 adaptively selects a charging voltage to be applied to the charging roller 110 according to the changes of resistance values input from the charging roller resistance detection unit 160 and the transfer roller resistance detection unit 170, to prevent the surface potential of the photosensitive drum 105 from being changed depending upon printing environments. In the example of the present invention, the printing environments affecting the resistance changes may be environmental conditions such as temperature or humidity, or mechanical defects such as aging or poor contacts of the charging roller 110 and the transfer roller 130.

Even when either the resistance value of the charging roller 110 or the resistance value of the transfer roller 130 is measured higher than actual due to the influence on printing environments discussed above, the present invention determines a charging voltage in consideration of both the resistance values, and prevents printed images from being deteriorated due to an overvoltage applied to the charging roller 110 or defects such as pinholes from occurring. For example, when the transfer roller resistance value is measured to be 30 MΩ and a charging roller resistance value is measured to be 120 MΩ due to defects of the charging roller 110, the control unit 190 determines as the charging voltage to be applied to the charging roller 110 a charging voltage value of −1.37 KV obtained where the transfer roller resistance value of 30 MΩ intersects with the charging roller resistance value of 120 MΩ. Accordingly, the present invention can solve the problem of deteriorating printed images that occurred in the prior art where with an overvoltage of −1.45 KV has applied to the charging roller 110 when the charging roller resistance value is measured to be 120 MΩ.

Figure 4:
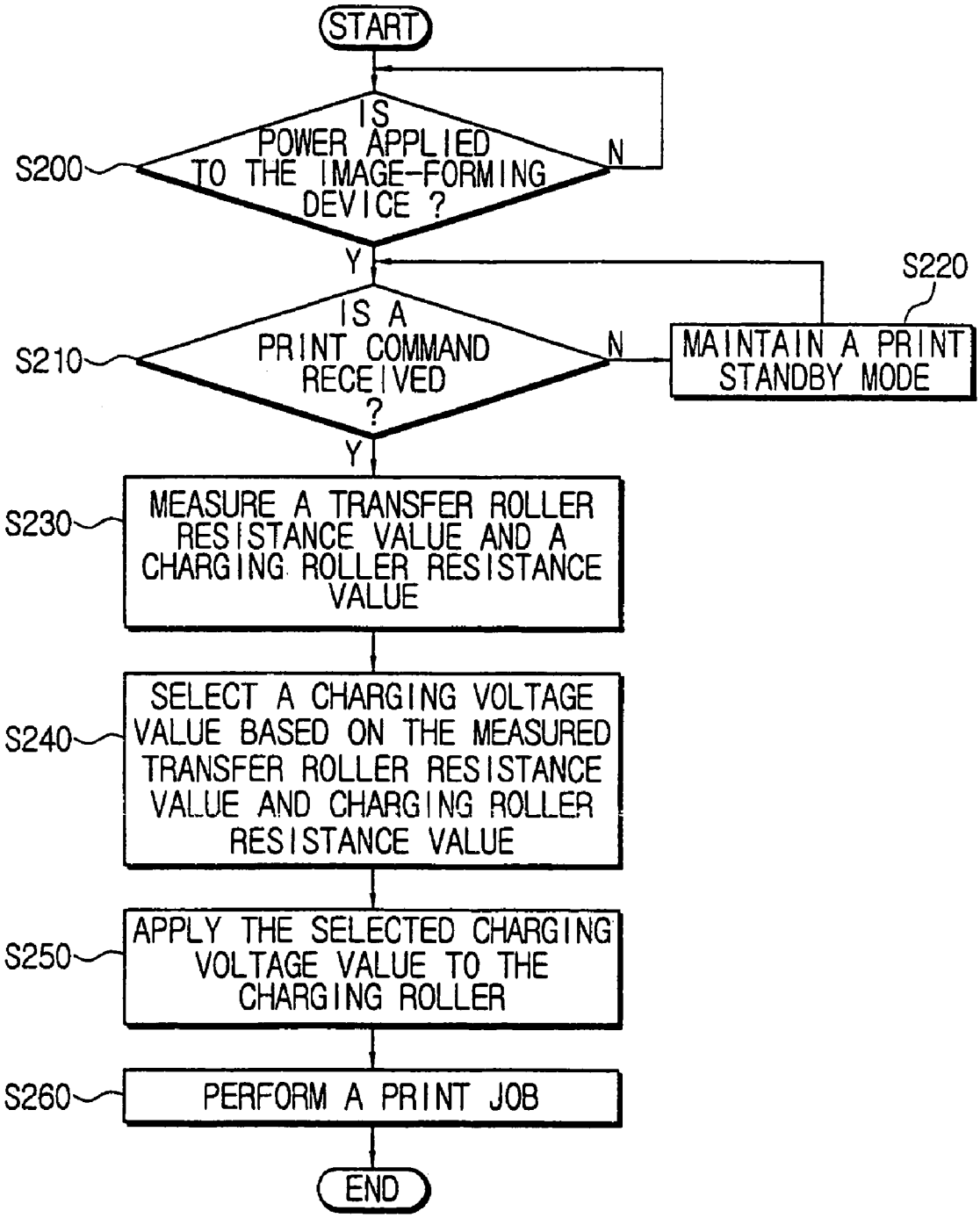
FIG. 4 is a flow chart explaining a charging voltage control method for the electrophotographic image-forming apparatus shown in FIG. 3.

Hereinafter, a description will be made on a charging voltage control method for an electrophotographic image-forming apparatus according to an embodiment of the present invention with reference to FIG. 3 and FIG. 4.

If power is applied to the image-forming device 100 (S200), the control unit 190 controls the HVPS 150 to apply predefined voltages to the rollers 110, 120, 125, and 130, respectively. Further, the control unit 190 maintains a print standby mode if a predetermined warming-up time lapses.

The control unit 190 decides whether a print command is externally received in the print standby mode (S210). If it is decided that the print command is received, the controller 190 stores the received print data in the storage unit 180. Meanwhile, if it is decided that the print command is not received in the step S210, the control unit 190 keeps the print standby mode (S220).

Further, the control unit 190 controls the transfer roller resistance detection unit 170 and the charging roller resistance detection unit 160 to measure the resistance value of the transfer roller 130 and the resistance value of the charging roller 110 prior to performing a print job. The charging roller resistance detection unit 160 and the transfer roller resistance detection unit 170 measure the resistance value of the charging roller 110 and the resistance value of the transfer roller 130, respectively, according to the controls of the control unit 190 (S230).

The control unit 190 selects a charging voltage value stored in the storage unit 180 based on the measured charging roller resistance value and transfer roller resistance value (S240). The control unit 190 controls the HVPS 150 to apply the selected charging voltage value to the charging roller 110 (S250). The HVPS 150 applies the selected charging voltage value to the charging roller 110 according to the controls of the control unit 190. Further, the control unit 190 performs a print job for the print data stored in the storage unit 180 (S260).

As described above, the present invention adaptively determines a charging voltage of the charging roller 110 according to the resistance value of the charging roller 110 and the resistance value of the transfer roller 130, to prevent the occurrence of defective images due to the uneven surface potential of the photosensitive drum 105 caused by the changes of the resistance values of the charging roller 110 and the resistance values of the transfer roller 130 depending upon the conditions of the print environments.

As described, the electrophotographic image-forming apparatus and charging voltage control method according to the present invention determine a charging voltage to be applied to the charging roller based on the resistance value of the charging roller and the resistance value of the transfer roller, taking into consideration the changes of the resistance values of the charging roller and transfer roller depending upon the conditions of the print environments such as the aging of the transfer roller or the poor contacts of the transfer roller or the charging roller, so that the present invention can improve print quality by maintaining the uniform surface potential of the photosensitive drum.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electrophotographic image-forming apparatus having a photosensitive medium and a laser scanning unit, comprising:

a charging roller applying a predetermined voltage to the photosensitive medium;

a developing roller developing with a developing agent an electrostatic latent image formed on the photosensitive medium by a laser scanning unit;

a transfer roller transferring onto a sheet of recording paper the image developed by the developing agent;

a high voltage power supply applying predefined voltages to the respective charging, developing, and transfer rollers;

a charging roller resistance detection unit detecting a resistance value of the charging roller;

a transfer roller resistance detection unit detecting a resistance value of the transfer roller; and a control unit determining a charging voltage to be applied to the charging roller based on the charging roller resistance value detected by the charging roller resistance detection unit and the transfer roller resistance value detected by the transfer roller resistance detection unit.

2. The electrophotographic image-forming apparatus as claimed in claim 1, further comprising a storage unit storing predetermined charging voltage values that correspond to the transfer roller resistance value and the charging roller resistance value, wherein the control unit selects a charging voltage value stored in the storage unit based on the transfer roller resistance value and the charging roller resistance value, and controls the high voltage power supply to apply the selected charging voltage value to the charging roller.

3. The electrophotographic image-forming apparatus as claimed in claim 1, wherein the charging roller resistance detection unit includes:

a charging roller resistance detector detecting current flowing between the charging roller and the photosensitive medium and calculating the charging roller resistance value based on a value of detected current; and an analog-to-digital (A/D) converter converting into a digital signal a signal corresponding to the charging roller resistance value output from the charging roller resistance detection unit and outputting the digital signal to the control unit.

4. The electrophotographic image-forming apparatus as claimed in claim 1, wherein the transfer roller resistance detection unit includes:

a transfer roller resistance detector detecting current flowing between the transfer roller and the photosensitive medium and calculating the transfer roller resistance value based on a value of the detected current; and an A/D converter converting into a digital signal a signal corresponding to the transfer roller resistance value output from the transfer roller resistance detector and outputting the digital signal to the control unit.

5. A charging voltage control method an electrophotographic image-forming apparatus having a charging roller applying a predetermined voltage to a photosensitive medium, a developing roller developing with a developing agent an electrostatic latent image formed on the photosensitive medium by an exposure unit, a transfer roller transferring onto a sheet of recording paper the image developed by the developing agent, a charging roller resistance detection unit detecting a resistance value of the charging roller, and a transfer roller resistance detection unit detecting a resistance value of the transfer roller, the method comprising:

calculating the charging roller resistance value between the charging roller and the photosensitive medium;

calculating the transfer roller resistance value between the transfer roller and the photosensitive medium; and determining a charging voltage to be applied to the charging roller based on the calculated transfer roller resistance value and charging roller resistance value.

6. The charging voltage control method as claimed in claim 5, wherein the charging voltage determination step determines a predefined charging voltage value as the charging voltage to be applied to the charging roller that corresponds to the transfer roller resistance value and the charging roller resistance value.

7. An image forming apparatus comprising:

an image bearing drum having a photoconductive property;

a charging device to impart a potential to the surface of the drum;

a developing unit to coat an image formed on the drum with toner forming a toner image;

a transfer device configured to transfer the toner image to a recording medium, wherein the transfer device is disposed below the drum and the recording medium is interposed between the drum and the transfer device;

a resistance detection unit to measure the resistance of the charging device and the transfer device;

a control unit that controls voltage levels applied to the charging device, the developing device and the transfer device, wherein the voltage applied to the charging device is relative to the resistance values measured by the charging device resistance detection unit and the transfer device resistance detection unit; and a fusing unit to fix the toner image on the recording medium.

8. The image forming apparatus as claimed in claim 7, further comprising a storage unit, wherein the storage unit stores image data used to form the image on the drum.

9. The image forming apparatus as claimed in claim 8, wherein the storage unit includes data that represents predetermined charging device voltage levels based on measured resistance values of the charging device and the transfer device.

10. The image forming apparatus as claimed in claim 9, further comprising a high voltage power supply responsive to signals from the control unit configured to apply specified voltage levels to the charging device, developing device and the transfer device.

11. The image forming apparatus as claimed in claim 7, wherein the resistance detection unit includes:

a first detection unit measuring the current flowing between the charging device and the drum and calculating the resistance value of the charging device from the measured current and applied voltage; and a second detection unit measuring the current flowing between the transfer device and the drum and calculating the resistance value of the charging device from the measured current and applied voltage.

12. The image forming apparatus as claimed in claim 11, wherein the first detection unit further includes an A/D converter that transmits the calculated resistance value to the control unit.

13. The image forming apparatus as claimed in claim 11, wherein the second detection unit further includes an A/D converter that transmits the calculated resistance value to the control unit.

14. The image forming apparatus as claimed in claim 7, wherein the developing unit further includes:

a developing roller; and a toner supply to supply toner to the developing roller wherein the image formed on the drum is coated with the toner forming the toner image.

15. A method of forming an image comprising:

determining a resistance value between a charging device and a photosensitive drum;

determining a resistance value between a transfer device and the photosensitive drum;

charging the charging device to a predetermined voltage level that is relative to the resistance values determined the charging device and the transfer device, to impart a potential to the photosensitive drum;

transferring an image to the photosensitive drum;

coating the image on the drum with toner forming a toner image;

transferring the toner image to a recording medium; and fusing the image to the recording medium.

16. The method of claim 15, wherein the predetermined voltage level is selected from a table of voltage levels stored in a storage unit that corresponds to the resistance values determined for the charging device and the transfer device.

* * * * *

UNITED STATES PATENT AND TRADEMARK OFFICE

CERTIFICATE OF CORRECTION

PATENT NO. : 7,050,732 B2
APPLICATION NO. : 10/750840
DATED : May 23, 2006
INVENTOR(S) : Byoung-chul Bae et al.

It is certified that error appears in the above-identified patent and that said Letters Patent is hereby corrected as shown below:

On Title Page and Col. 1, Line 4 (Item 54) change "THEREOF" to -- THEREFOR--.

Signed and Sealed this

Twenty-first Day of November, 2006

JON W. DUDAS
*Director of the United States Patent and Trademark Office*